US005638079A

United States Patent [19]

Kastner et al.

[11] Patent Number: 5,638,079

[45] Date of Patent: Jun. 10, 1997

[54] SLOTTED WAVEGUIDE ARRAY ANTENNAS

[75] Inventors: Raphael Kastner, Haifa; Ovadia Haluba, Ra'anana, both of Israel

[73] Assignee: Ramot University Authority For Applied Research & Industrial Development Ltd., Tel Aviv, Israel

[21] Appl. No.: 337,096

[22] Filed: Nov. 10, 1994

[30] Foreign Application Priority Data

Nov. 12, 1993 [IL] Israel ..... 107582

[51] Int. Cl.[6] ..... H01Q 13/10

[52] U.S. Cl. ..... 343/770; 343/771; 343/768

[58] Field of Search ..... 343/771, 770, 343/767, 768; H01Q 13/10

[56] References Cited

U.S. PATENT DOCUMENTS

| | | | |
|---|---|---|---|
| 3,183,511 | 5/1965 | Ajioka | 343/771 |
| 3,189,908 | 6/1965 | Provencher | 343/771 |
| 3,193,830 | 7/1965 | Provencher | 343/771 |
| 3,224,004 | 12/1965 | Barthez | 343/771 |
| 3,829,862 | 8/1974 | Young | 343/767 |
| 3,987,454 | 10/1976 | Epis | 343/771 |
| 3,990,079 | 11/1976 | Epis | 343/771 |
| 4,119,971 | 10/1978 | Stark | 343/771 |
| 4,170,778 | 10/1979 | Bowman | 343/771 |
| 4,477,874 | 10/1984 | Ikuta et al. | 364/424 |
| 4,513,291 | 4/1985 | Drabowitch | 343/771 |
| 4,554,550 | 11/1985 | Lopez | 343/771 |
| 4,554,551 | 11/1985 | Frazita | 343/771 |
| 4,590,478 | 5/1986 | Powers et al. | 343/700 |
| 4,638,323 | 1/1987 | Shnitkin et al. | 343/771 |
| 4,658,261 | 4/1987 | Reid et al. | 343/771 |
| 4,814,779 | 3/1989 | Levine | 343/771 |
| 4,821,044 | 4/1989 | Kurtz | 343/771 |
| 4,873,528 | 10/1989 | Girard | 343/770 |
| 5,019,831 | 5/1991 | Yee et al. | 343/770 |
| 5,068,670 | 11/1991 | Maoz | 343/767 |
| 5,081,466 | 1/1992 | Bitter | 343/767 |
| 5,177,494 | 1/1993 | Dorrie et al. | 343/711 |
| 5,187,489 | 2/1993 | Whelan et al. | 343/767 |

FOREIGN PATENT DOCUMENTS

| | | | |
|---|---|---|---|
| 0126626 | 11/1984 | European Pat. Off. | 343/771 |

OTHER PUBLICATIONS

J. Green et al, "Assymetric Ridge Waveguide Radiating Element for a Scanned Planar Array", IEEE Trans., vol. 38, No. 8., Aug. 1990, 1161–1165.

K. Garb et al, "Analysis of Longitudinal Slots in Ridged Waveguides . . . ", Dept. of Phys. Elec., Fac. of Eng., Tel Aviv University.

S.B. Cohen, "Properties of Ridge Wave Guide", Proc. of the IR Aug. 1947, 783–787.

J.R. Pyle, "The Cutoff Wavelength of the TE Mode in Ridged Rectangular Waveguide of Any Aspect Radio", IEEE Trans. on Microwave Theory & Tech., vol.MTT14, No.4, Apr., 1996, 175–18.

L.A. Kurtz et al, "Second–Order Beams of Two–Dimensional Slot Arrays", IRE Trans. on Antennas & Prop., Oct., 1957, 356–362.

S. Silver, "Microwave Antenna Theory & Design", McGraw–Hill Book Co., New York, NY, 1949, pp. 318–321.

H. Gruenberg, "Second–Order Beams of Slotted Wave Guide Array Can. Jou. of Physics", vol. 31, pp. 55–69. (Apr. 1951).

*Primary Examiner*—Hoanganh T. Le
*Attorney, Agent, or Firm*—Ladas & Parry

[57] ABSTRACT

A slotted waveguide array antenna includes a plurality of waveguide elements extending in a parallel side-by-side relation, each having a radiating side including a broad wall formed with a plurality of slots, and an asymmetric ridge. The slots are slanted to the longitudinal axis of the antenna in alternating directions and are spaced λg/2 apart such as to offset phase reversal between each pair of adjacent slots.

8 Claims, 3 Drawing Sheets

SLOTTED WAVEGUIDE ARRAY ANTENNAS

FIELD AND BACKGROUND OF THE INVENTION

The present invention relates to planar array antennas, and particularly to the slotted waveguide planar array antennas.

The performance of planar arrays comprising longitudinal (shunt) slot radiators in the broad wall of conventional rectangular waveguides has a number of limitations: The scan range in the plane perpendicular to the waveguide axis (E-plane) is restricted because of the relatively large width of the waveguide which translates into a wide inter-element spacing in this plane. This wide spacing also hampers sidelobe control. The purpose of sidelobe control would have been best served by an arrangement of columns of collinear slots with narrow spacing between the columns; however this arrangement is not possible in conventional rectangular waveguides because longitudinal slots must be arranged in staggered configuration. Moreover, polarization is limited to the plane perpendicular to the waveguide axis.

Transversal (series) slots, on the other hand, while potentially providing orthogonal polarization, are not used in conventional arays because of the difficulty associated with their incorporation into a serial waveguide array.

The ridged waveguide may have a much narrower cross section than the rectangular waveguide, and as such it holds promise for constructing slot arrays with narrower inter-element spacing in the E-plane, thus providing a solution to the scan and sidelobe limitations of conventional rectangular waveguides. However, symmetrical ridge waveguides are limited in the area over which longitudinal slots can be cut; therefore the dynamic range is limited. In addition, polarization is still limited to the E-plane.

The idea of asymmetric ridge waveguides is described in H. Shnitkin and J. Green, "Asymmetric Ridge Waveguide Collinear Slot Array Antenna", U.S. Pat. No. 4,638,323, Jan. 20, 1987, and the paper J. Green, B. Shnitkin and Paul J. Bertalan, "Asymmetric Ridge Waveguide Radiating Element for a Scanned Planar Array", IEEE Trans. on Antennas and propagation Vol. 38, No. 8. pp. 1161–1165, August 1990. In order to increase the dynamic range of the slots, the ridge is constructed in an asymmetric manner, thereby allowing a wider region on one of its sides for placing longitudinal slots, but includes alternating side chambers on opposite sides of the ridge alternating between high and low level. Longitudinal slots are fed out of phase every one-half a waveguide wavelength ($\lambda g$); therefore they must be placed at opposing sides of the broad walls of conventional or symmetrical ridge waveguides.

In the array antenna described in U.S. Pat. No. 4,638,323, ridge asymmetry is obtained by including, on opposite sides of the ridge, side chambers alternating between high and low levels. The above patent and the publication relating thereto also disclose the idea of providing a meandering ridge to produce ridge asymmetry. However, the structures described in that patent and publication are difficult to construct mechanically; moreover, they may generate high order modes at the bends of the ridges.

Slotted waveguide array antennas of this type are also described in U.S. Pat. Nos. 3,189,908, 4,658,261, 4,873,528, 3,193,830, 3,183,511, 4,513,291, 4,821,044, 4,554,550 and 4,554,551.

OBJECTS AND BRIEF SUMMARY OF THE INVENTION

An object of the present invention is to provide a slotted waveguide array antenna of a novel construction having advantages over the previously known antennas as will be described more particularly below.

According to the present invention, there is provided a slotted waveguide array antenna comprising a plurality of waveguide elements extending in a parallel side-by-side relation, each waveguide element having a longitudinal axis, a radiating side including a broad wall formed with a plurality of slots, a non-radiating side opposite to the radiating side, and a single asymmetric ridge in the non-radiating side; characterized in that the single asymmetric ridge is a straight continuous ridge extending parallel to, laterally of, and asymmetrical with respect to, the longitudinal axis of the waveguide element. Such an asymmetric ridge construction has advantages over the meandering ridge construction described in the above-cited U.S. Pat. No. 4,638,323, in that mechanically, it is simpler to construct, and electrically, it avoids the generation of high order modes at the bends of the ridges.

According to further features in the described preferred embodiments of the invention, the antenna is further characterized in that the slots are slanted to the longitudinal axis of the antenna in alternating directions and are spaced $\lambda g/2$ apart such as to offset phase reversal between each pair of adjacent slots.

In One described embodiment, the slots in each waveguide element are slanted in alternating directions. In this described embodiment, the antenna includes means for feeding the slanted slots at locations where the ridge traverses the slot, to provide control over the slot impedance and the amount of power lea into each slot, to thereby produce a high-dynamic range of the slots.

A second embodiment is described wherein the plurality of waveguide elements are arranged in pairs in which the slots of one waveguide element in each pair are slanted parallel to each other and to the axis of the respective waveguide element, and the slots of the other waveguide element in each pair are also slanted parallel to each other and to the axis of the respective waveguide element, but in the opposite direction to that of the one waveguide element of the respective pair. In this described embodiment, the antenna includes: a first power network for feeding the one waveguide element of all the pairs; a second power network for feeding the other waveguide element of all the pairs; and a phase shifting network between the first and second power networks. The arrangement is such that:

(a) when the two waveguides of each pair are in phase, linear polarization is generated perpendicular to the waveguide axis; (b) when the two waveguides of each pair are out of phase, orthogonal linear polarization is generated; and (c) when the waveguides are fed in phase quadrature, circular polarization is generated.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF PREFERRED EMBODIMENTS

Figure 1:
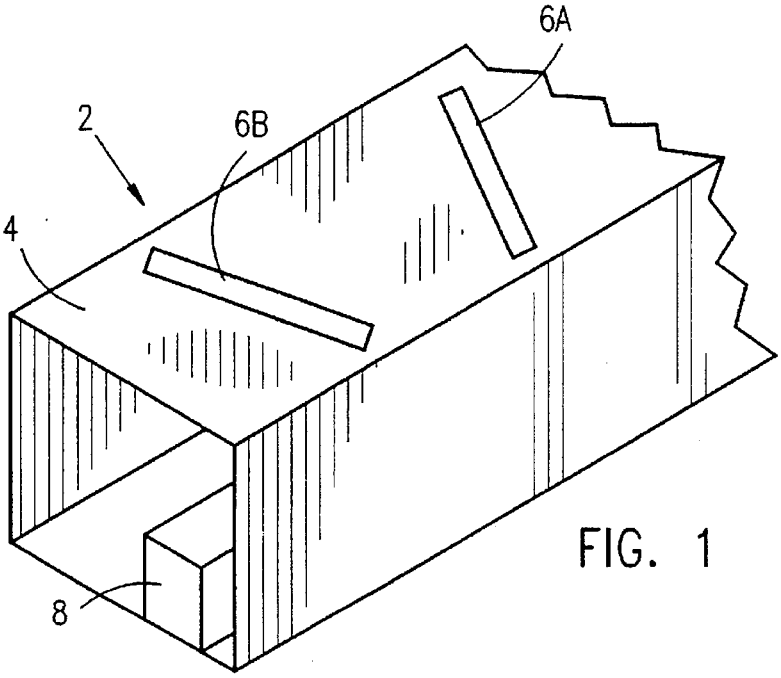
FIG. 1 schematically illustrates a part of one waveguide element which may be used in constructing a slotted waveguide array antenna in accordance with the present invention.
Figure 2:
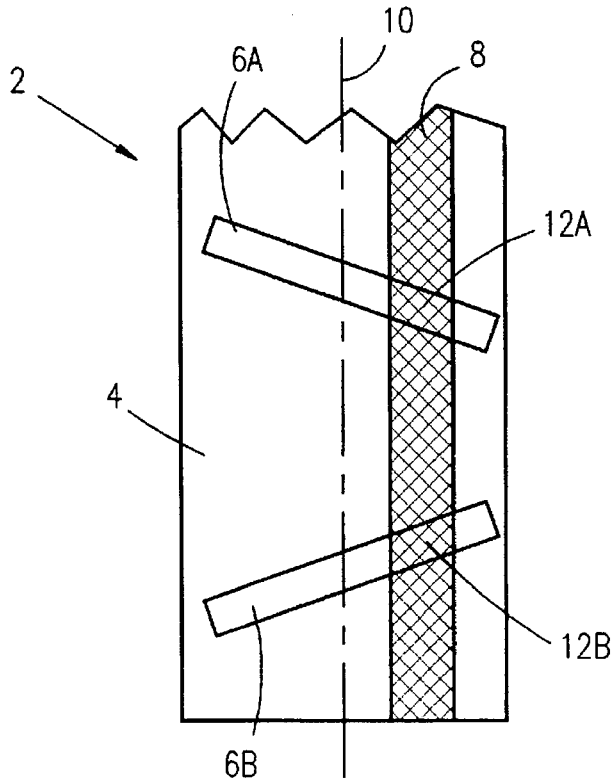
FIG. 2 is a top plan view of FIG. 1.

The invention will be better understood by reference first to the part of the waveguide element illustrated in FIG. 1 and 2, and therein generally designated 2, which may be used in constructing a slanted waveguide array antenna in accordance with the present invention.

The part of the waveguide element 2 illustrated in FIGS. 1 and 2 has a radiating side including a broad wall 4 formed with a plurality of slots 6*a*, 6*b*, and a non-radiating side, opposite to the radiating side of broad wall 4, and formed with a single ridge 8 which is asymmetric to the longitudinal axis 10 of the waveguide element. As clearly seen in FIGS. 1 and 2, the asymmetric ridge 8 is a continuous ridge extending parallel to and laterally of the longitudinal axis 10; also, the slots 6*a*, 6*b* are slanted to the longitudinal axis of the waveguide element 2 in alternating directions. They are spaced λg/2 apart. The alternating directions offset the phase reversal between any two adjacent slots.

The slots are fed at the locations where the ridge 8 traverses the respective slot, as shown at points 12*a* and 12*b* for slots 6*a*, 6*b*, respectively. In this way, resonant slots can be cut in the broad wall 4 of the ridge waveguide, which is narrower than the broad wall of a rectangular waveguide and which therefore does not accommodate transversal slots.

The polarization in the construction illustrated in FIGS. 1 and 2 is perpendicular to the waveguide axis, similar to longitudinal slots. However, better control can be obtained of the slot impedance and the amount of power fed into each slot by selecting these feed point, resulting in high dynamic range of the slots.

Figure 3:
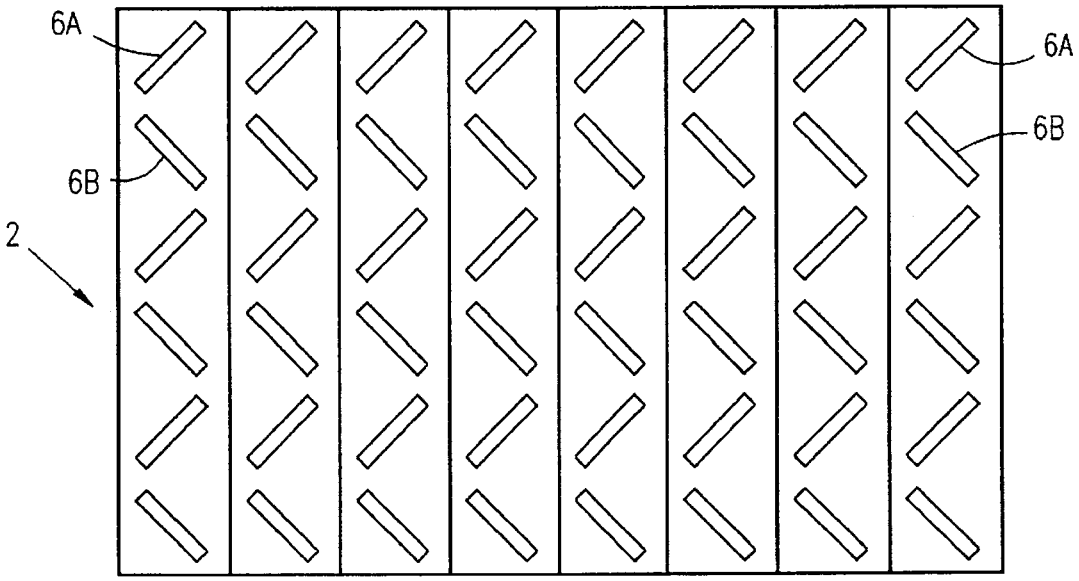
FIG. 3 illustrates a slotted waveguide array antenna including a plurality of the waveguide elements of FIGS. 1 and 2.

FIG. 3 illustrates a slotted waveguide array antenna including a plurality of the waveguide elements 2 of FIGS. 1 and 2. Spacing between adjacent waveguides in the antenna of FIG. 3 is smaller than in the conventional rectangular waveguide antenna, thereby facilitating wider scan range and lower sidelobes, especially in the intercardinal planes.

Figure 4:
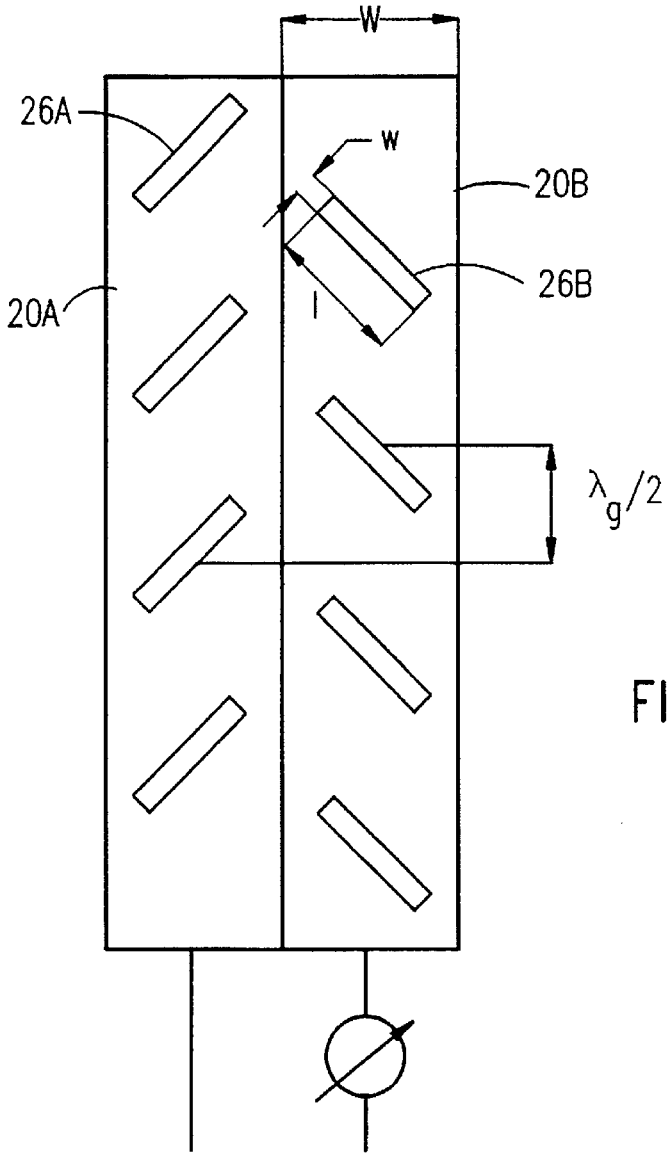
FIG. 4 illustrates a pair of waveguide elements in another form of slotted waveguide array antenna constructed in accordance with the present invention.
Figure 5:
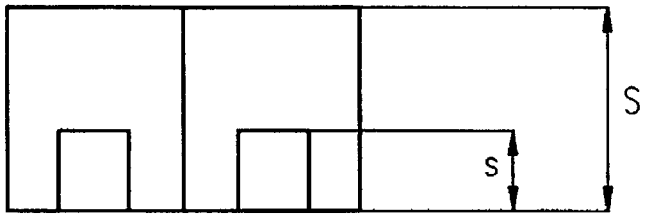
FIG. 5 is an end view of the waveguide elements of FIG. 4.

FIG. 4 illustrates a pair of waveguide elements for use in a switchable multi-polarization array antenna constructed in accordance with the present invention.

The pair of waveguide elements illustrated in FIG. 4 are generally designated 20*a*, 20*b*, respectively. Each includes a plurality of slots 26*a*, 26*b* formed in the broad wall of the radiating side of the waveguide element. In this case, however, the slots 26*a*, 26*b* in adjacent waveguide elements extend in opposite directions. The slots in each element are spaced apart λg, so that the spacing between the slots in adjacent elements is λg/2, thereby providing in-phase excitation. Each pair of such waveguides thus form a single antenna "element" whose width is smaller than a wavelength and is thus suitable for limited scan in the plane perpendicular to the waveguide axis.

Figure 6:
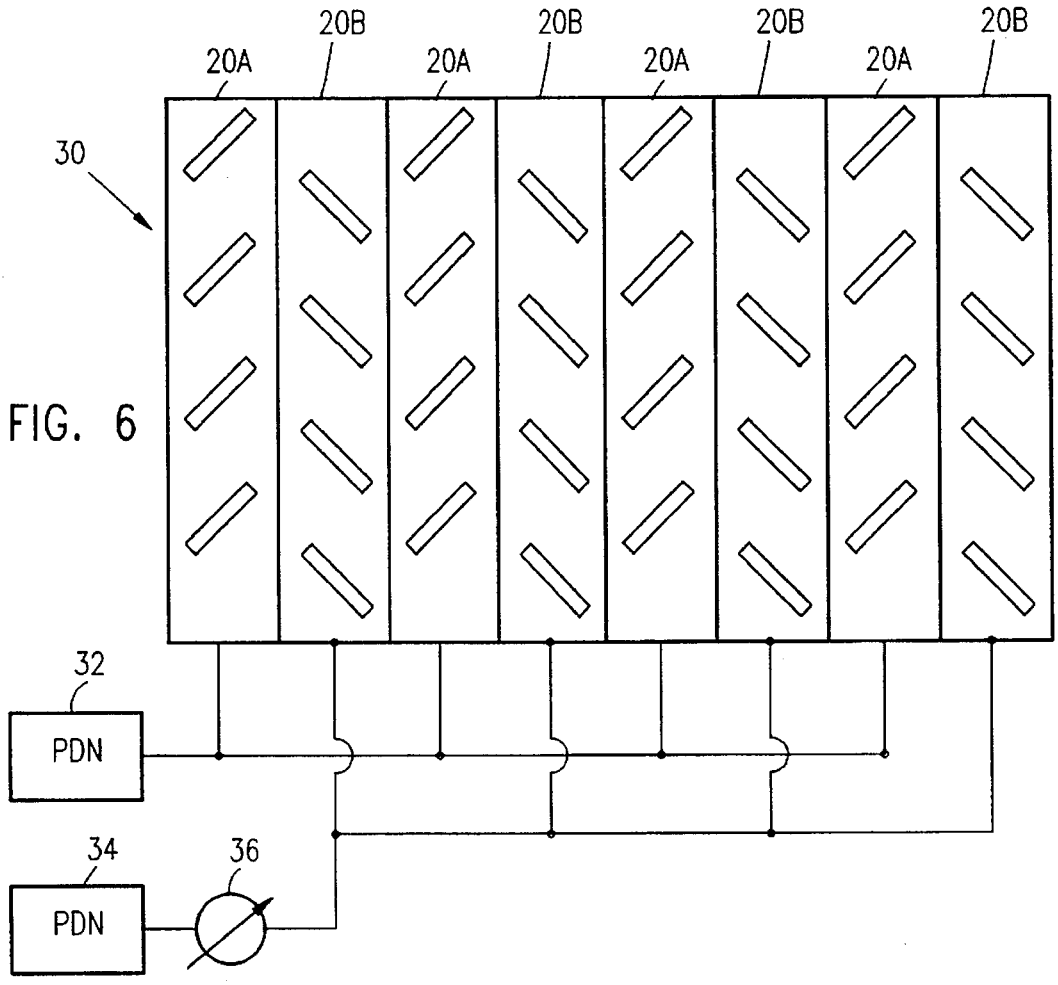
FIG. 6 illustrates a slotted waveguide array antenna including a plurality of pairs of waveguide elements according to FIGS. 4 and 5.

FIG. 6 illustrates a plurality of pairs of such waveguide elements arranged in parallel relationship to produce a switchable multi-polarization array antenna, generally designated 30. Each pair thus includes the two elements 20*a*, 20*b*. It will be seen that all the waveguide elements 20*a*, constituting one element of each pair, are connected to power dividing network 32, and that all the elements 20*b*, constituting the other elements of the waveguide pairs, are connected to a separate power dividing network 34 via a phase-shift network 36.

The arrangement illustrated in FIG. 6 enables the polarization of the antenna to be controlled. Thus, when the group of waveguide elements 20*a* are energized in phase with the group of waveguide elements 20*b*, the polarization is linear and perpendicular to the waveguide axis. When the energization of the two groups of waveguides is out of phase, orthogonal linear polarization is generated; and when the energization of the two groups is in phase quadrature, circular polarization is generated. In this manner, the phase shift network 36 may be used to control the polarization of the antenna to enable it to be switched dynamically from one polarization to another.

Following is one example of dimensions in millimeters for an antenna operating in the C-band: the width (W) of each waveguide element 20*a*, 20*b* is 2.80 mm; the width (w) of each slot 26*a*, 26*b* is 1.60 mm; the length (l) of each slot 26*a*, 26*b* is 20.75 mm; λg/2 is 21.40 mm; the distance (S) between the radiating and non-radiating sides of the antenna is 8.0 mm; and the distance (s) between the top of the ridge and the non-radiating side of the antenna is 5.5 mm.

While the invention has been described with respect to two preferred embodiments, it will be appreciated that these are set forth merely for purposes of example, and that many other variations, modifications and applications of the invention may be made.

What is claimed is:

1. A slotted waveguide array antenna comprising a plurality of waveguide elements extending in a parallel side-by-side relation, each waveguide element having a longitudinal axis, a radiating side including a broad wall formed with a plurality of slots, a non-radiating side opposite to said radiating side, and a single asymmetric ridge in said non-radiating side; characterized in that said single asymmetric ridge is a straight continuous ridge extending parallel to, laterally of, and asymmetrical with respect to, said longitudinal axis of the waveguide element, and in that said slots are slanted to the longitudinal axis of the antenna in alternating directions and are spaced λg/2 apart such as to offset phase reversal between each pair of adjacent slots.

2. The antenna according to claim 1, wherein said antenna includes means for feeding the slanted slots at locations where the ridge traverses the slot, to provide control over the slot impedance and the amount of power fed into each slot, to thereby produce a high dynamic range of the slots.

3. A slotted waveguide array antenna comprising:

a plurality of waveguide elements extending in a parallel side-by-side relation, each waveguide element having a longitudinal axis a radiating side including a broad wall formed with a plurality of slots, a non-radiating side opposite to said radiating side, and a single asymmetric ridge in said non-radiating side;

said slots being slanted to the longitudinal axis of the antenna in alternating directions and being spaced λg/2 apart such as to offset phase reversal between each pair of adjacent slots;

said single ridge in all the waveguide elements being a straight continuous ridge extending parallel to, laterally of, and asymmetrical with respect to, said longitudinal axis of the respective waveguide element.

4. The antenna according to claim 3, wherein said slots in each waveguide element are slanted in alternating directions.

5. The antenna according to claim 4, wherein said antenna includes means for feeding the slanted slots at locations where the ridge traverses the slot, to provide control over the slot impedance and the amount of power fed into each slot, to thereby produce a high dynamic range of the slots.

6. The antenna according to claim 3, wherein said plurality of waveguide elements are arranged in pairs, the slots of one waveguide element in each pair being slanted parallel to each other and to the axis of the respective waveguide element, and the slots of the other waveguide element in each pair also being slanted parallel to each other and to the axis of the respective waveguide element, but in the opposite direction to the slots of said one waveguide element of the respective pair.

7. The antenna according to claim 6, further including a first power network for feeding said one waveguide element of all the pairs, a second power network for feeding said other waveguide element of all the pairs, and a phase shifting network between said second power network and said other waveguide element of all the pairs such that: (a) when the two waveguides of each pair are in phase, linear polarization is generated perpendicular to the waveguide axis; (b) when the two waveguides of each pair are out of phase, orthogonal linear polarization is generated; and (c) when the two waveguides of each pair are fed in phase quadrature, circular polarization is generated.

8. A slotted waveguide array antenna comprising a plurality of waveguide elements extending in a parallel side-by-side relation, each waveguide element having a longitudinal axis, a radiating side including a broad wall formed with a plurality of slots, a non-radiating side opposite to said radiating side, and a single asymmetric ridge in said non-radiating side; characterized in that said single asymmetric ridge is a straight continuous ridge extending parallel to, laterally of, and asymmetrical with respect to, said longitudinal axis of the waveguide element.

* * * * *